US006036531A

United States Patent [19]

Lee et al.

[11] Patent Number: 6,036,531

[45] Date of Patent: Mar. 14, 2000

[54] INSULATION DISPLACEMENT CONTACT CONNECTOR

[75] Inventors: George Lee, Taipei; Tsun-Shen Shao, Pan-Chiao; Hsien-Chu Lin, Tar-Sea, all of Taiwan

[73] Assignee: Hon Hai Precision Ind. Co., Ltd., Taipei Hsien, Taiwan

[21] Appl. No.: 09/123,120

[22] Filed: Jul. 27, 1998

[30] Foreign Application Priority Data

Aug. 16, 1997 [TW] Taiwan ..... 86214200

[51] Int. Cl.[7] ..... H01R 13/58

[52] U.S. Cl. ..... 439/459; 439/405; 439/701

[58] Field of Search ..... 439/453, 454, 439/455, 456, 458, 459, 460, 463, 387, 358, 404–405, 417, 435, 470, 701

[56] References Cited

U.S. PATENT DOCUMENTS 4,006,957 2/1977 Narozny ..... 439/459
5,125,850 6/1992 Locati ..... 439/404
5,266,048 11/1993 Brekosky et al. ..... 439/470
5,762,513 6/1998 Stine ..... 439/358
5,772,467 6/1998 Burgess ..... 439/493

*Primary Examiner*—Lincoln Donovan

[57] ABSTRACT

An insulation displacement contact connector for engaging with a predetermined section of a flat cable comprises an insulative housing having a plurality of contacts projecting therefrom each including a piercing end. Two receptacles extend from distal ends of the housing and each receptacle is a closure defining a slit from an upper edge to a lower edge thereof resulting in tolerance space when an external part is inserted into the receptacle. An insulative cover and a locking cover are engaged with the housing in order to force the piercing ends of the contacts to be electrically connected to the cable, wherein the insulative cover and the locking cover each have two arms inserted into the receptacles, respectively, while not damaging the housing.

9 Claims, 3 Drawing Sheets

INSULATION DISPLACEMENT CONTACT CONNECTOR

BACKGROUND OF THE INVENTION

1. Field of The Invention

The present invention relates to an insulation displacement contact connector, and particularly to an insulation displacement contact connector which can properly position a flat cable without affecting the integrity thereof.

2. The Prior Art insulation displacement contact connectors, also known as flat cable connectors or ribbon cable connectors, are widely used to configure cables in a cable assembly for transmitting signals between computers and peripheral devices. Generally, the flat cable consists of a plurality of parallel conductive lines each of which is enclosed in a sheath made of an insulative material such as plastic. An insulation displacement contact connector is commonly used to connect the flat cable by piercing the corresponding sheath of each line and fixing the flat cable at an engaging line which is substantially perpendicular to the elongate direction of the flat cable.

Each insulation displacement contact connector usually comprises an insulative cover, an insulative housing, locking cover having two extending arms and a plurality of contacts received in the insulative housing. While configuring the connector with the flat cable, the insulative cover and the insulative housing are coupled in a first status thus defining a reception space therebetween for reception of a selected section of the flat cable (hereinafter referred to as engagement section). The insulative cover is then compressed onto the engagement section of the flat cable and the insulative housing by a jig or the like to facilitate the related contacts of the insulative housing to pierce the sheath of the flat cable and electrically engage with the exposed conductive lines. Meanwhile, the engagement section of the flat cable is fixed between the insulative cover and the insulative housing. Finally, the locking cover is positioned on the insulative cover with the extending arms being inserted into the insulative housing substantially abutting against two side walls thereof. However, in a practical configuration, the engagement section of the flat cable is not always located at an optimum position for correct piercing by the related contacts of the insulative housing.

Some prior art has formed the insulative cover to be clip-shaped or consisting of two pieces so as to solve the improper piercing problem, such as in U.S. Pat. No. 4,359,257. Although the piercing problem seems to have been solved by the above prior art, problems due to either an exceedingly wide or narrow flat cable with respect to the reception space defined between the insulative cover and the insulative housing usually cause an unwanted curved portion or a misalignment configuration at the engagement section of the flat cable, thus reducing the yield of the cable assembly. Moreover, the side wall upper portion of the insulative housing is apt to be broken due to compression from the insulative cover. Therefore, it is requisite to provide a new insulation displacement contact connector to solve the above problems.

SUMMARY OF THE INVENTION

The primary purpose of the present invention is to provide a new insulation displacement contact connector for proper connection to a flat cable which won't damage the flat cable during assembly.

In accordance with one aspect of the present invention, an insulation displacement contact connector for engaging with a predetermined section of a flat cable, comprises an insulative housing having a plurality of contacts projecting therefrom each including a piercing end. Two receptacles are attached to distal ends of the housing and each receptacle is a closure defining a slit from an upper edge to a lower edge thereof resulting in an expandable space when an external part is inserted in the receptacle. An insulative cover comprises an elongate portion on which a plurality of waved grooves are formed and two engagement arms extending downward from distal ends of the elongate portion, wherein each engagement arm includes two legs connected by a lateral portion thus defining a channel therebetween. A locking cover has an intermediate portion and two arms extending downward from distal ends thereof, whereby the insulative cover is engaged with the housing with each engagement arm thereof being firmly retained in the receptacle of the housing. Simultaneously, the flat cable is compressively retained between the grooves of the insulative cover and the piercing ends of the contacts. The locking cover is further attached to the insulative cover with each arm thereof being received in the channel of the engagement arm of the insulative cover.

DETAILED DESCRIPTION OF THE PREFERRED EMBODIMENTS

Reference will now be described in detail to the preferred embodiment of the invention.

Figure 1:
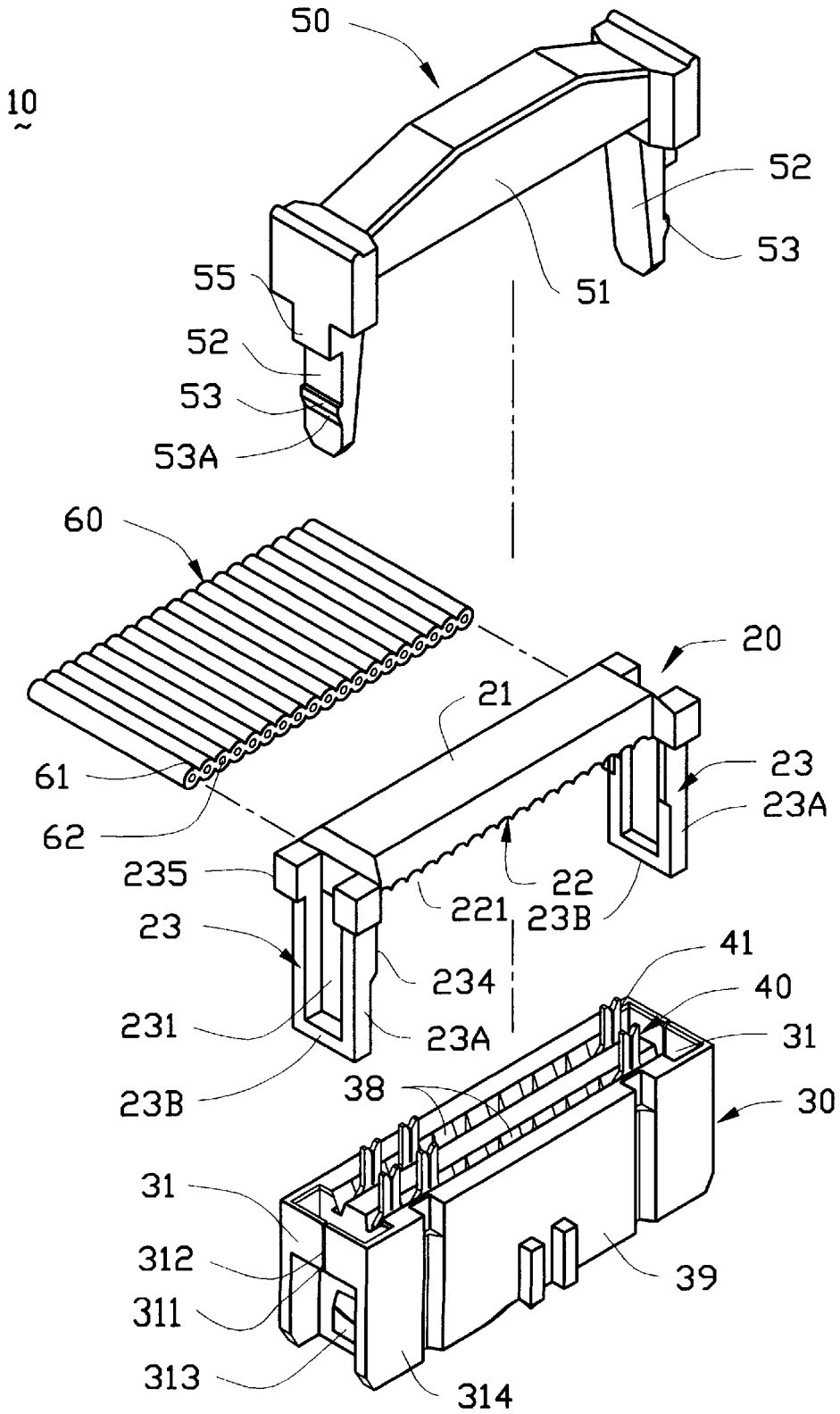
FIG. 1 is an exploded perspective view of an insulation displacement contact connector in accordance with the present invention.

Referring to the drawings and initially to FIG. 1, an insulation displacement contact connector 10 in accordance with the present invention comprises a locking cover 50, an insulative cover 20, an insulative housing 30, and a plurality of contacts 40 received in the insulative housing 30. A flat cable 60 is connected with the insulation displacement contact connector 10 from a lateral direction with respect to the orientation of this figure.

The insulative cover 20 comprises an elongate bridging portion 21 having a lower face 22 formed with a plurality of waved grooves 221 for reception and retention of a lateral section of the flat cable 60. Two engagement arms 23 respectively extend downward from two sides of the bridging portion 21 of the insulative cover 20, thus the elongate bridging portion 21 together with the two engagement arms 23 constitute a substantially U-shaped clip to engage with the insulative housing 30.

Each arm 23 is a U-shaped structure comprising two legs 23A substantially parallel to each other and a lateral portion 23B connected between the two legs 23A thereby defining a channel 231 therebetween. Each leg 23A has a protrusion 234 projecting toward a corresponding leg 23A of the opposite arm 23. The distance between each opposite pair of protrusions 234 is predetermined to be identical to the width of the flat cable 60 so that the flat cable 60 can be fitted exactly in the space between the two pairs of opposite protrusions 234 without any compression problems occurring in the flat cable 60 when it is engaged with the insulation displacement contact connector 10. Each leg 23A has a stop 235 projecting from an upper portion thereof. The grooves 221 formed in the lower face 22 of the elongate bridging portion 21 cooperate with the arms 23 to facilitate the lines of the flat cable 60 to align with corresponding contacts 40 extending from the housing 30. Each line of the flat cable 60 comprises a conductive core 62 surrounded by a corresponding sheath 61.

The insulative housing 30 is substantially an elongate structure which includes a body portion 39 and two receptacles 31 attached to opposite ends of the body portion 39 respectively.

Each receptacle 31 comprises two parallel side walls 314 extending from one end of the housing 30 and a lateral outer wall 311 connected between the two side walls 314. The outer wall 311 defines a slit 312 from an upper edge to a lower edge thereof for providing an expandable space when an external member is inserted into the receptacle 31. A tapered protrusion 313 extends from an inner wall of the receptacle 31 confronting the outer wall 311. The body portion 39 defines two rows of spaced staggered passageways 38. Each contact 40 is partially received in and partially projects upward from the corresponding passageway 38. Each contact 40 has a piercing end 41 formed like a fork for piercing the sheath 61 of the cable 60 in order to electrically engage with the conductive core 62.

The locking cover 50 is a U-shaped structure having an intermediate portion 51 and two arms 52 extending downward from distal ends of the intermediate portion 51. Each arm 52 has a protrusion 53 projecting therefrom and a stop 55 at an intermediate portion thereof. Specifically, the protrusion 53 has a tapered face 53A tapering downward.

A first configuration status and a second configuration status are subsequently experienced when configuring the flat cable 60 into the insulation displacement contact connector 10, which are respectively shown in FIGS. 2 and 3.

Figure 2:
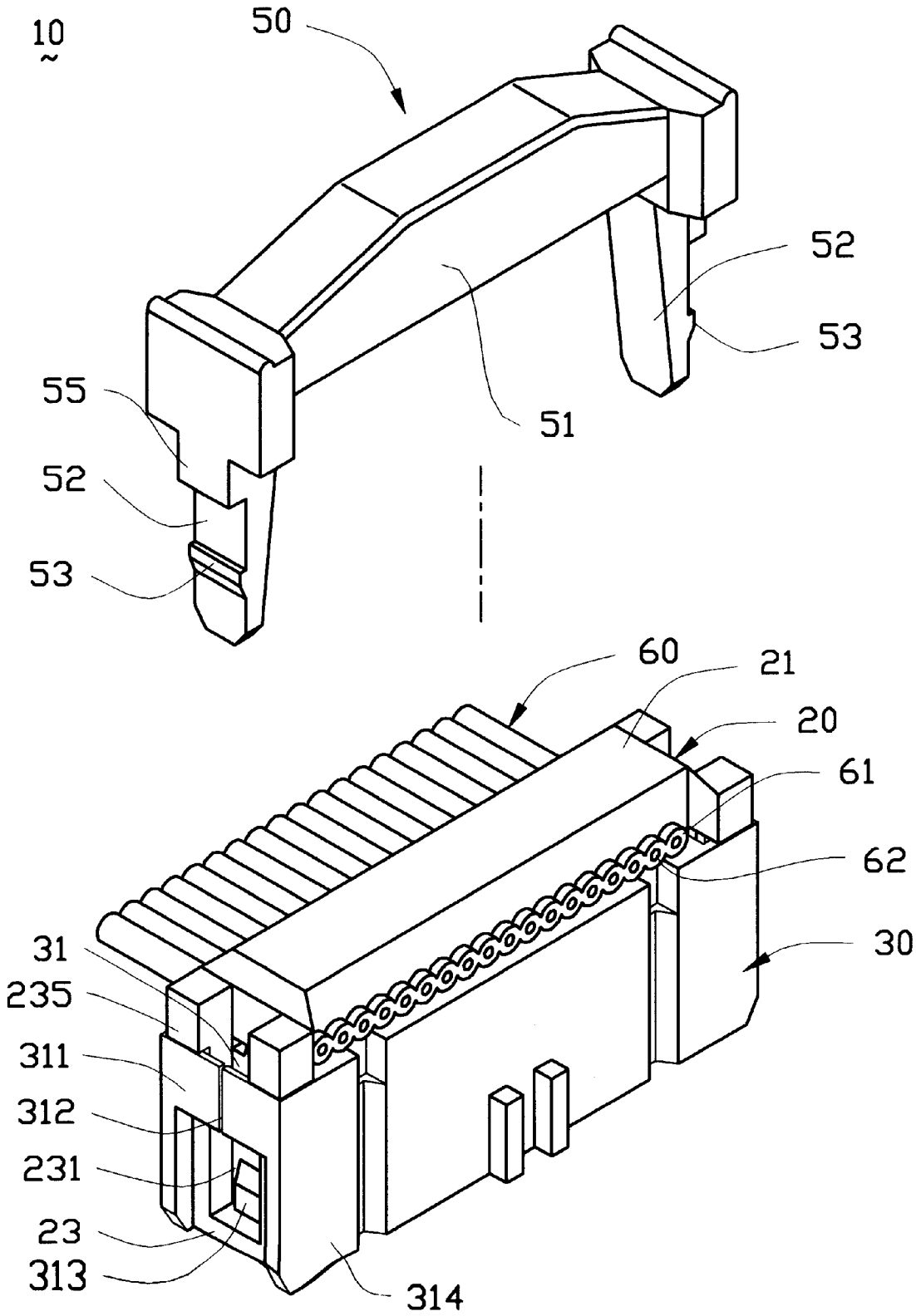
FIG. 2 is a partial assembled view of FIG. 1, with a locking cover thereof separated from the subassembly.

Referring to FIG. 2, the arms 23 of the insulative cover 20 are initially inserted into the two receptacles 31, with the cable 60 being positioned between the grooves 221 of the lower face 22 and the piercing ends 41 of the contacts 40, and the conductive cores 62 of the cable 60 being electrically connected to the contacts 40, the stops 235 thereof abutting against the upper edge of the lateral outer wall 311, the lateral portion 23B of the arm 23 sliding over the tapered protrusion 311 of the inner wall and forcibly attaching to a lower edge of the tapered protrusion 313. Therefore, the cable 60 is fixed in the housing 30 and electrically connected to the contacts 40 after the first configuration status. During the insertion of the engagement arms 23 into the receptacles 31, the slit 312 in the lateral outer wall 311 of each receptacle 31 provides sufficient tolerance thereby preventing the housing 30 from breaking. However, the cable 60 may be pulled away from the engaged insulation cover 20 and housing 30 by a considerable external force, therefore the second configuration is subsequent from the first configuration status.

Figure 3:
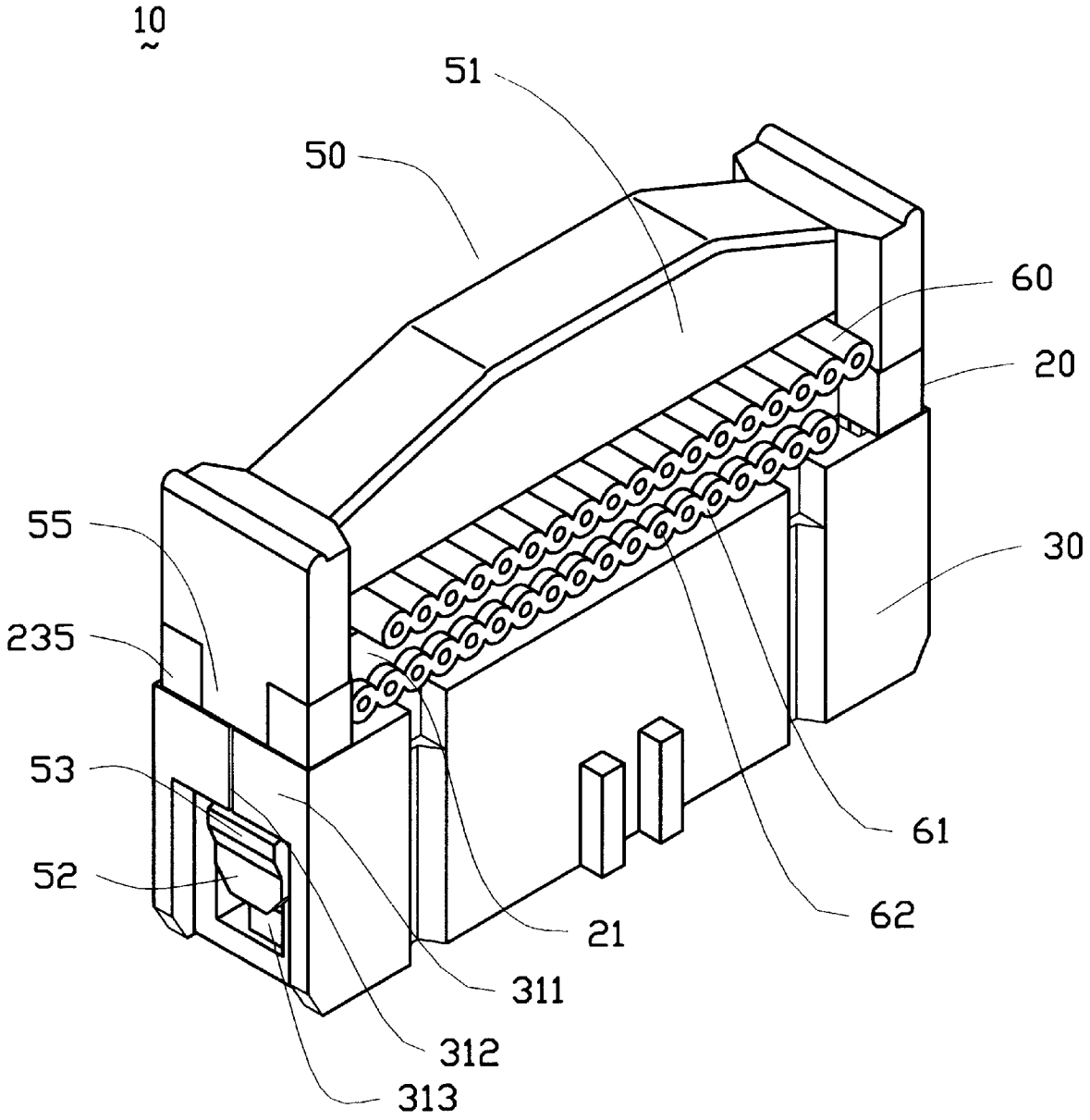
FIG. 3 is a fully assembled view of FIG. 1.

Referring to FIG. 3, during the second configuration status, the cable 60 is reversibly folded onto the top face of the insulation cover 20 and the locking cover 50 is mounted on the cable 60. The intermediate portion 51 compresses the reversed portion of the cable 60, the arm 52 is received in the channel 231 of the engagement arm 23 of the insulative cover 20, and the stop 55 and the protrusion 53 are firmly attached to the upper and lower edges of the lateral outer wall 311 of the receptacle 31, respectively. The tapered face 53A of the protrusion 53 facilitates downward passage of the protrusion 53 through the lateral outer wall 311. The slit 312 of the lateral outer wall 311 provides expandable elasticity for the receptacle 31 during insertion of the arm 52 of the locking cover 50.

With the above new insulation displacement contact connector 10 and the related two-status assembly method, the flat cable 60 can be properly configured with the new connector 10.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. An insulation displacement contact connector assembly including:

an insulative housing receiving a plurality of contacts therein;

two receptacles respectively formed at two opposite ends of the housing, each of said receptacles having a resiliently deflectable lateral outer wall, an inner wall opposite the outer wall and two opposite side walls interconnecting the outer wall and the inner wall thereby providing an expandable space, the side walls being deflectable independent of the lateral outer wall;

an insulative cover having two opposite engagement arms latched to the receptacles of the insulative housing; and a locking cover including two arms respectively formed at two opposite ends thereof, each of said two arms including an outward protrusion capable of outwardly deflecting the lateral outer wall to permit the arm to be inserted into the expandable space of a corresponding receptacle, thereby latchably engaging the arm with said receptacle.

2. The connector assembly as claimed in claim 1, wherein the engagement arms are each formed with an inwardly projecting protrusion spaced a distance equal to a width of a flat cable.

3. The connector assembly as claimed in claim 1, wherein the lateral outer wall comprises a first and a second lateral portions respectively extending from the side walls.

4. A connector assembly including:

an insulative housing having a plurality of contacts therein;

two receptacles respectively formed at two opposite ends of the housing;

an insulative cover adapted to be latched unto the insulative housing;

a locking cover including two arms at two opposite ends of thereof corresponding to said two receptacles, respectively;

an outward protrusion formed on each of said arms for preventing withdrawal of the locking cover from the housing in a vertical direction; and a slit formed in a lateral outer wall of each of the receptacles for providing deflection of the receptacle in a longitudinal direction of the housing.

5. The connector assembly as claimed in claim 1, wherein the lateral outer wall is deflectable in a longitudinal direction relative to the housing, and wherein the side walls are deflectable in a lateral direction relative to the housing.

6. The connector assembly as claimed in claim 3, wherein the first and the second lateral portions define a slit therebetween.

7. An insulation displacement contact connector assembly including:

an insulative housing and a plurality of contacts received in the insulative housing;

two receptacles respectively formed on two opposite ends of the housing, each receptacle having a lateral outer wall, an inner wall opposite the outer wall and a pair of opposite side walls interconnecting the outer wall and the inner wall, the outer wall defining a slit from an upper edge to a lower edge thereof; and an insulative cover having a pair of opposite engagement arms, each engagement arm outwardly biasing the side walls and therefore being resiliently retained in a corresponding receptacle by the outer walls.

8. The connector assembly as claimed in claim 7, wherein the engagement arms are resiliently retained in corresponding receptacles in a lateral and a longitudinal directions relative to the insulative housing.

9. The connector assembly as claimed in claim 7, further comprising a locking cover having two opposite arms for engaging with corresponding engagement arms of the insulative cover, each arm having an outward protrusion for latchably engaging with corresponding lateral outer wall.

* * * * *